US005379604A

United States Patent [19]

Furr

[11] Patent Number: 5,379,604

[45] Date of Patent: Jan. 10, 1995

[54] EMERGENCY REFRIGERANT RECOVERY ACTIVATION SYSTEM

[75] Inventor: Patrick L. Furr, Houston, Tex.

[73] Assignee: Houston Industries Incorporated, Houston, Tex.

[21] Appl. No.: 155,013

[22] Filed: Nov. 19, 1993

[51] Int. Cl.[6] ..... F25B 45/00

[52] U.S. Cl. ..... 62/77; 62/228.3; 62/174

[58] Field of Search ..... 62/174, 149, 228.1, 62/228.3, 77

[56] References Cited

U.S. PATENT DOCUMENTS

| | | | |
|---|---|---|---|
| 1,815,962 | 7/1931 | Andrews | 62/149 |
| 2,059,942 | 11/1936 | Gibson . | |
| 2,682,752 | 7/1954 | Branson . | |
| 2,966,668 | 12/1960 | Hillman et al. . | |
| 3,064,445 | 11/1962 | Gerteis . | |
| 3,238,737 | 3/1966 | Shrader et al. . | |
| 3,400,552 | 9/1968 | Johnson et al. . | |
| 3,508,236 | 4/1970 | Adams . | |
| 3,517,692 | 6/1970 | Elrod . | |
| 3,608,324 | 9/1971 | Singleton et al. . | |
| 3,736,763 | 6/1973 | Garland . | |
| 4,300,066 | 11/1981 | Butler III . | |
| 4,332,136 | 6/1982 | Quack . | |
| 4,408,194 | 8/1983 | Thompson . | |
| 4,420,943 | 12/1983 | Clawson . | |
| 4,470,265 | 9/1984 | Correia . | |
| 4,663,608 | 5/1987 | Kelly . | |
| 4,757,261 | 7/1988 | Kneip, Jr. . | |
| 4,809,515 | 3/1989 | Houwink | 62/149 |
| 5,067,327 | 11/1991 | Leblanc . | |
| 5,186,017 | 2/1993 | Hancock et al. . | |
| 5,219,041 | 6/1993 | Greve . | |
| 5,222,369 | 6/1993 | Hancock et al. . | |
| 5,319,945 | 6/1994 | Bartlett | 62/174 |

OTHER PUBLICATIONS

Kunkle Valve Division, Model 6000 Series Catalog Sheet, 1992.

York International, VentGuard Catalog Sheet, 1992.

*Primary Examiner*—John M. Sollecito

*Attorney, Agent, or Firm*—Pravel, Hewitt, Kimball & Krieger

[57] ABSTRACT

A system is provided at the emergency pressure release in an air conditioning refrigerant system. The system protects the environment from venting of the pressurized refrigerant. The system also permits recovery of the refrigerant for subsequent use or for environmentally safe disposal.

13 Claims, 1 Drawing Sheet

EMERGENCY REFRIGERANT RECOVERY ACTIVATION SYSTEM

BACKGROUND OF THE INVENTION

1. Field of Invention

The present invention relates to control systems for recovery of refrigerant from air conditioning systems.

2. Description of Prior Art

Fluorocarbons have been widely used as the refrigerant in chiller units for air conditioning, or HVAC, systems. Some of the most widely used fluorocarbons have been types of chlorinated fluorocarbon (CFC) sold under the trademark FREON®. In recent years, environmental concerns have arisen about fluorocarbon or CFC refrigerants and their possible harmful effects on the earth's atmosphere. Although until recently only disfavored for environmental reasons, it has now become unlawful to purposefully vent chlorinated fluorocarbon refrigerants to the atmosphere. For this and other reasons, the cost of such refrigerants has increased significantly. Although accidental leakage from system failures or breakdowns is not unlawful, it has become a very expensive and undesirable situation.

Generally, existing HVAC units have a graphite rupture disk on a centrifugal chiller unit as a portion of the original equipment. The disk has been designed to rupture when the system refrigerant pressure reached a specified excess pressure limit, typically 15 psig or so. In the past, refrigerant which escaped in the event of disk rupture was vented into the atmosphere.

Certain types of systems are available which attempt to limit or reduce the venting of refrigerant. These systems use a relief valve which opens at the excess pressure limit and closes again at a certain fraction or percentage (such as two-thirds) of the pressure limit. However, these systems allow repeated cycles of opening the relief valve, to vent refrigerant at the excess pressure limit, with subsequent closing of the relief valve. Eventually, unless the excess pressure problem was corrected, the entire charge of refrigerant could be vented in increments to the atmosphere.

SUMMARY OF INVENTION

Briefly, the present invention provides a new and improved system for refrigerant recovery in emergency situations. The system according to the present invention includes a pressure sensor to sense pressure of excess pressure refrigerant escaping from an air conditioning unit. Operation of the air conditioning unit is stopped in the event that excess pressure in the refrigerant is sensed, and an alarm is activated. A transfer conduit is provided to convey the excess pressure refrigerant to a refrigerant recovery unit, and a transfer valve is included in the transfer conduit. The transfer valve is opened in response to excess pressure refrigerant conditions so that the excess pressure refrigerant is transported to the recovery unit, reducing the escape of the refrigerant. The apparatus of the present invention also preferably includes a relief valve in fluid communication with the refrigerant recovery unit so that excess pressure refrigerant may be recovered instead of venting it into the atmosphere. Alternatively, but less preferred, the relief valve may initially allow excess pressure refrigerant to be vented from the air conditioning unit to the atmosphere.

DESCRIPTION OF THE PREFERRED EMBODIMENT

Figure 1:
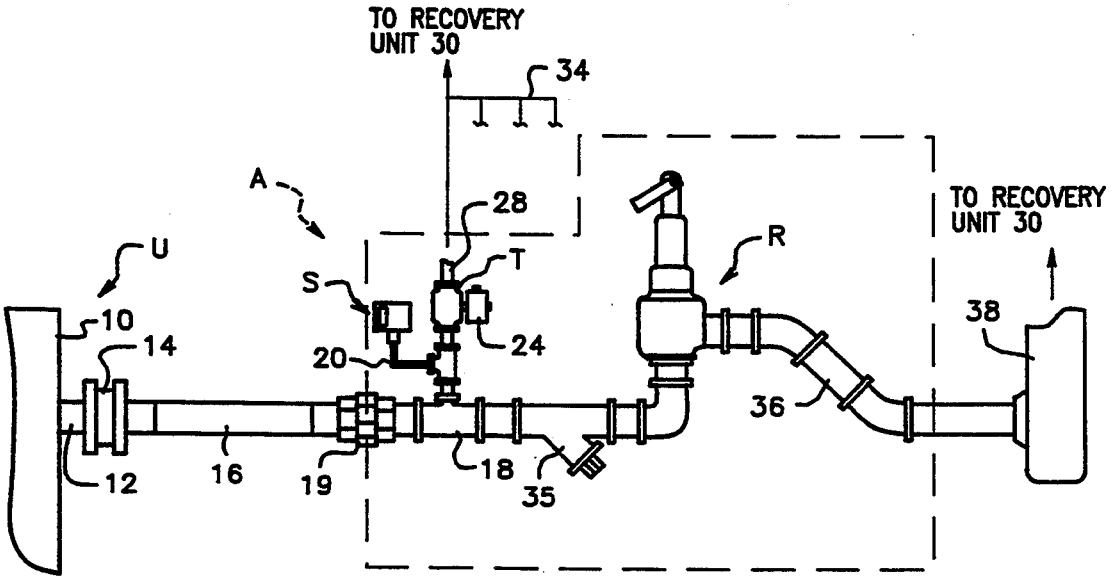
FIG. 1 is a schematic diagram of a system according to the present invention.

In the drawings, the letter A designates generally an apparatus according to the present invention in the form of a control system for an air conditioning or HVAC unit or system. The apparatus of the present invention is adapted for recovery of refrigerant and control of the venting of such refrigerant in the event of high pressure conditions in the air conditioning unit. Typically, the refrigerant in the unit is a chlorinated fluorocarbon (CFC), although it should be understood that other refrigerants are recoverable with the apparatus of the present invention.

The apparatus A is connected to an HVAC unit U, typically at a chiller 10, by a conduit 12 and a conventional flange mounted pressure sensitive mechanism 14 in the form of a graphite rupture disk. The rupture disk 14 is intended to rupture in the event that pressure of the refrigerant in the unit U exceeds an established limit, usually in the range of about 15 psig. In the past, the refrigerant has been vented to the atmosphere in its entirety usually at rupture of the disk or in successive stages, as detailed above.

A vibration absorber 16 is typically connected at the output of the pressure-sensitive rupture disk 14 and connects a relief conduit 18 of the apparatus A to the air conditioning unit U. In the event that the vibration absorber 16 is not used, the relief conduit 18 itself connects the apparatus A directly to the rupture disk 14 and thus to the air conditioning unit U. The relief conduit 18 conveys excess pressure refrigerant from the rupture disk 14 to a relief valve R and a pressure sensor S.

The relief conduit 18 is shown in the preferred embodiment as a conduit section connected by fittings to other conduits or tubing in the apparatus A. It should be understood that the fittings and connections shown are given by way of example and that other fluid transport connections may also be used. For example, the relief conduit 18 may be directly connected to the vibration absorber 16 rather than through a fitting 19, as shown.

Figure 2:
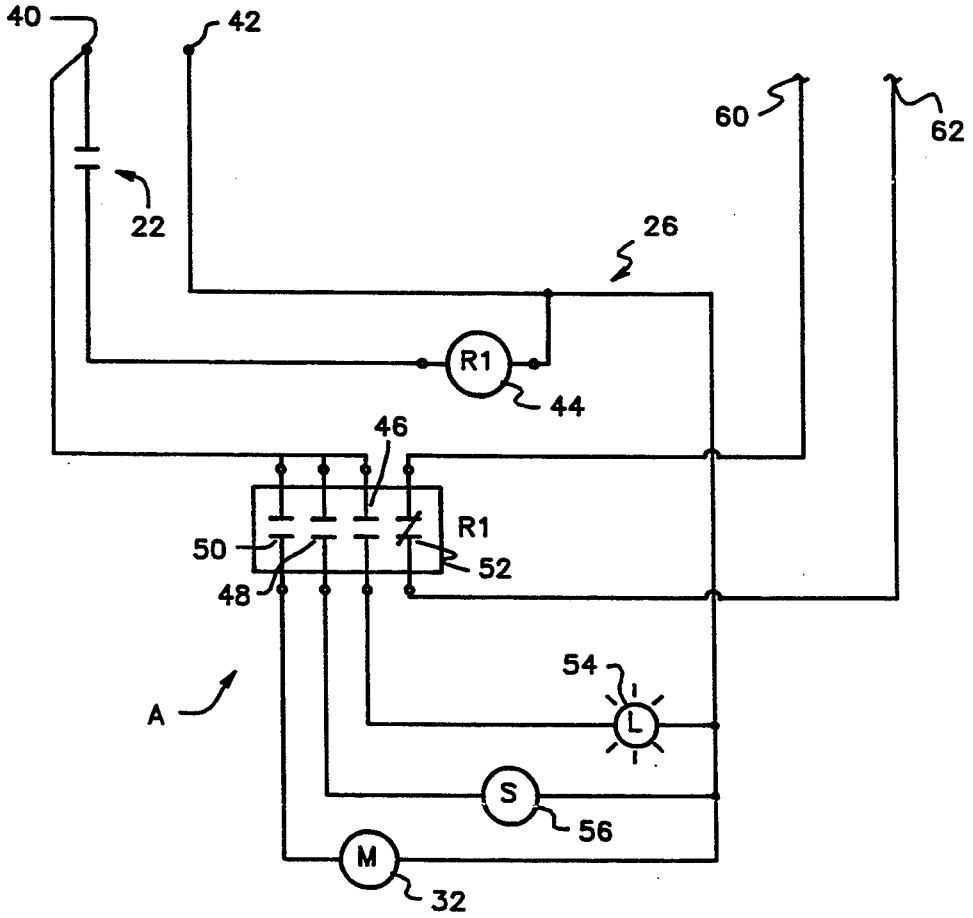
FIG. 2 is a schematic electrical circuit diagram of the system of FIG. 1.

The pressure sensor S is connected by a tube or conduit 20 to the relief conduit 18. The pressure sensor S includes a pressure sensitive electrical switch 22 (FIG. 2) which closes in the event of excess pressure refrigerant in the relief conduit 18.

The apparatus A also includes a transfer valve T in fluid communication with the relief conduit 18. The transfer valve T is a solenoid operated valve, opening and closing in response to a solenoid 24 which is electrically connected in a control circuit arrangement 26 (FIG. 2) operating under control of the pressure/electric switch 22.

The transfer valve T when open permits refrigerant in the relief conduit 18 to pass into a transfer conduit 28. The transfer conduit 28 is in fluid communication between the transfer valve T and a conventional refrigerant recovery unit 30, which may be of any suitable type. The recovery unit 30 includes a starter motor 32 electrically connected (FIG. 2) in the control circuit 26 with the pressure/electric switch 22.

If desired, several apparatus A according to the present invention may be connected at their respective transfer conduits 28 through a manifold arrangement 34 shown schematically in common to the refrigerant recovery unit 30.

The relief valve R is in fluid communication with the relief conduit 18, either directly or through additional conduits and connecting fittings. A strainer section 35 is provided, either in the relief conduit 18 or in another of the connecting conduits or fittings, to receive broken pieces of the rupture disk 14. In this manner, broken pieces of the rupture disk 14 do not interfere with operation of the relief valve R, the transfer valve T or the pressure sensor S.

The relief valve R is operable to open at a predetermined pressure, usually at or near the rupture pressure of the disk 14, to permit escaping refrigerant to pass into an outlet conduit 36. The outlet conduit 36 may be connected directly or through other pipes, fittings or connectors between the relief valve R and the pipe 38. The particular connection arrangement depends upon location of the components of the apparatus A at the site and other factors.

The outlet conduit 36 is connected at an outlet opposite the relief valve R to a conduit or pipe 38. Preferably, the pipe 38 is connected to the refrigerant recovery unit 30, as is the transfer conduit 28. In this manner, substantially all of the refrigerant escaping on rupture of the disk 14 is transported to the recovery unit 30 where it may be recovered. This is desirable for environmental, as well as, economic reasons. In some situations, however, the conduit or pipe 38 may in the alternative serve to vent limited initial portions of the escaping refrigerant to the atmosphere.

The control circuit 26 is electrically connected to a suitable electrical power supply at power supply terminals 40 (FIG. 2) and 42. The pressure/electrical switch 22 and a control relay coil 44 are electrically connected between the power supply terminals 40 and 42. The relay coil 44 includes normally open contacts 46, 48 and 50 as well as normally closed contact 52. The normally open contact 46 electrically connects an alarm 54 between the power supply terminals 40 and 42 when the coil 44 receives current. The alarm 54 may be a light or other signal emitter, or other visible or audible alarm, including a telemetry unit.

The normally open contact 48 electrically connects a solenoid coil 56 of the solenoid 24 between the power supply terminals 40 and 42 when the control relay coil 44 receives current. The solenoid coil 56 in this condition causes the solenoid 24 to open the transfer valve T, allowing escaping refrigerant from the disk D in the relief conduit 18 to pass into the transfer conduit 28 and thence into the recovery unit 30.

The normally open contact 50 electrically connects the starter motor 32 of the recovery unit 30 between the power supply terminals 40 and 42 when the control relay coil 44 receives electrical current. When the starter motor 32 is so energized, the recovery unit 30 begins operation, recovering the refrigerant present in the transfer conduit 28 and, where it is so connected, in the pipe 38.

The normally closed contact 52 is designed to open when the control relay coil 44 receives current. The contact 52 is electrically connected at its output terminals 60 and 62 into the control circuit of the HVAC unit U. When the contact 52 opens, the control circuit of the unit U is de-energized, stopping operation of the air conditioning unit U, typically at the chiller 10.

In the operation of the present invention, the HVAC unit U operates in the normal manner until the pressure of the refrigerant in the unit U exceeds the pressure limit of the rupture disk 14. At this point, the excess pressure refrigerant ruptures the disk 14 and passes into the relief conduit 18 to both the pressure sensing mechanism S and the relief valve R. The pressure/electric switch 22 in the pressure sensor S closes at this point, allowing current to flow through the control relay coil 44 in the control circuit 26.

The escaping refrigerant in the relief conduit 18 also passes into the relief valve R. Depending upon the pressure setting of the relief valve R, an initial portion of the escaping refrigerant may pass into the outlet conduit 36 and pipe 38 and therefrom into the recovery unit. Alternatively, in the event that the pressure setting of the relief valve R is higher than that of the pressure/electric switch 22, the relay coil 44 causes the normally open contacts 46, 48, and 50 to close, and the normally closed contacts 52 to open.

The contacts 46 on closing permit electrical current to flow to the alarm 54, while the contacts 48 on closing energize the solenoid coil 56, causing the transfer valve T to open. When the transfer valve T opens, the refrigerant in the relief conduit 18 passes into the transfer conduit 28 to the recovery unit 30. Contemporaneously with the operation of the solenoid coil 56, the contacts 50 on closing permit electrical current to flow to the starter motor 32 of the recovery unit, so that recovery of the refrigerant present in the transfer conduit 28 and the pipe 38 may begin.

At the same time that the normally open contacts 46, 48, and 50 close, the normally closed contacts 52 open, interrupting operation of the control circuit of the HVAC unit U. At this point, the operation of the unit U is stopped.

From the foregoing, it can be seen that the apparatus A according to the present invention activates recovery of the refrigerant from the air conditioning unit U in the event of excess pressure in the unit U. Operation of the air conditioning unit U is stopped in the event of such excess pressure in the refrigerant being sensed, and the alarm 54 is activated. Contemporaneously, the transfer valve T is opened in response to excess pressure refrigerant conditions so that the excess pressure refrigerant is transported to the recovery unit 30 through the transfer valve T and transfer conduit 28.

In this manner, escape of the pressurized refrigerant is substantially reduced. With the apparatus A, the relief valve R is preferably in fluid communication through the pipe 38 to the refrigerant recovery unit 30 so that excess pressure refrigerant which might otherwise pass through the relief valve R, and be vented to the atmosphere, may be recovered as well.

The foregoing disclosure and description of the invention are illustrative and explanatory thereof, and various changes in the size, shape, materials, components, circuit elements, wiring connections and contacts, as well as in the details of the illustrated circuitry and construction and method of operation may be made without departing from the spirit of the invention.

I claim:

1. An apparatus connectable to an air conditioning unit with a pressure sensitive mechanism which breaks in the event of excess pressure in the unit, for activating recovery of refrigerant from the air conditioning unit in the event of excess pressure rupturing the pressure sensitive mechanism, comprising:

a relief valve for allowing the excess pressure refrigerant to be vented;

pressure sensor means for sensing the pressure of the excess pressure refrigerant;

a relief conduit for conveying the excess pressure refrigerant from the pressure sensitive mechanism to said relief valve and said pressure sensor means;

means responsive to said pressure sensor means for activating an alarm to indicate excess pressure in the refrigerant;

a transfer conduit to convey the excess pressure refrigerant to a refrigerant recovery unit;

a transfer valve connecting said relief conduit and said transfer conduit; and means responsive to said pressure sensor means for opening said transfer valve.

2. The apparatus of claim 1, further including:

means responsive to said pressure sensor means for starting the refrigerant recovery unit.

3. The apparatus of claim 1, further including:

a conduit to convey excess pressure refrigerant from said relief valve to the refrigerant recovery unit.

4. The apparatus of claim 1, further including:

a vent pipe for venting excess pressure refrigerant prior to opening of said transfer valve.

5. The apparatus of claim 1, further including:

means responsive to said pressure sensor means for stopping operation of the air conditioning unit.

6. The apparatus of claim 1, further including:

a manifold connected to said transfer conduit and adapted to connect to other transfer conduits for excess pressure refrigerant from other recovery units.

7. An apparatus connectable to a pressure sensitive mechanism which breaks in the event of excess pressure in an air conditioning unit for reducing the escape of excess pressure refrigerant from the air conditioning unit in the event of excess pressure in the unit, comprising:

pressure sensor means for sensing the pressure of the excess pressure refrigerant;

a relief conduit for conveying the excess pressure refrigerant from the pressure sensitive mechanism to said pressure sensor means;

means responsive to said pressure sensor means for stopping operation of the air conditioning unit;

means responsive to said pressure sensor means for activating an alarm to indicate excess pressure in the refrigerant;

a transfer conduit to convey the excess pressure refrigerant to a refrigerant recovery unit;

a transfer valve connecting said relief valve and said transfer conduit; and means responsive to said pressure sensor means for opening said transfer valve.

8. The apparatus of claim 7, further including:

means responsive to said pressure sensor means for starting the refrigerant recovery unit.

9. The apparatus of claim 7, further including:

a relief valve for allowing excess pressure refrigerant to be vented.

10. The apparatus of claim 9, further including:

a conduit to convey excess pressure refrigerant from said relief valve to the refrigerant recovery unit.

11. The apparatus of claim 7, further including:

a manifold connected to said transfer conduit and adapted to connect to other transfer conduits for excess pressure refrigerant from other recovery units.

12. A method of reducing the escape of excess pressure refrigerant from a pressure sensitive mechanism connected to an air conditioning unit in the event of rupture of the pressure sensitive mechanism to prevent release of refrigerant from the unit, comprising the steps of:

sensing the pressure of the released refrigerant in a relief conduit leading from the pressure sensitive mechanism;

stopping operation of the air conditioning unit in response to sensing excess pressure of the released refrigerant in the relief conduit;

activating an alarm to indicate excess pressure in the released refrigerant in the relief conduit; and transferring the excess pressure released refrigerant from the relief conduit to a refrigerant recovery unit.

13. The method of claim 12, further including the step of:

starting the refrigerant recovery unit in response to sensing excess pressure of the released refrigerant in the relief conduit.

* * * * *